United States Patent [19]

Cheung

[11] Patent Number: 4,560,397

[45] Date of Patent: Dec. 24, 1985

[54] PROCESS TO PRODUCE ULTRAHIGH PURITY OXYGEN

[75] Inventor: Harry Cheung, Buffalo, N.Y.

[73] Assignee: Union Carbide Corporation, Danbury, Conn.

[21] Appl. No.: 641,205

[22] Filed: Aug. 16, 1984

[51] Int. Cl.[4] ..... F25J 3/04

[52] U.S. Cl. ..... 62/28; 62/30; 62/31; 62/34

[58] Field of Search ..... 62/28, 27, 23, 24, 29, 62/30, 22, 18, 31, 32, 33, 34, 42

[56] References Cited

U.S. PATENT DOCUMENTS

| | | | |
|---|---|---|---|
| 2,046,284 | 6/1936 | Boshkoff | 62/122 |
| 2,497,589 | 2/1950 | Dennis | 62/175.5 |
| 2,519,892 | 8/1950 | Dennis | 62/175.5 |
| 2,603,956 | 7/1952 | Borchardt | 62/122 |
| 2,793,511 | 5/1957 | Bonnand | 62/175.5 |
| 3,203,193 | 8/1965 | Ruhemann et al. | 62/13 |
| 3,217,502 | 11/1965 | Keith | 62/13 |
| 3,363,427 | 1/1968 | Blanchard et al. | 62/21 |
| 3,620,032 | 11/1971 | Simonet | 62/28 |
| 3,736,762 | 6/1973 | Toyama et al. | 62/13 |

*Primary Examiner*—Frank Sever

*Attorney, Agent, or Firm*—Stanley Ktorides

[57] ABSTRACT

A process for the production of ultrahigh purity oxygen and elevated pressure nitrogen by the cryogenic rectification of air wherein the product oxygen is recovered from a secondary column at a point above the liquid sump while impurities are removed from the column at a distance from the product withdrawal point.

33 Claims, 3 Drawing Figures

PROCESS TO PRODUCE ULTRAHIGH PURITY OXYGEN

TECHNICAL FIELD

This invention relates generally to the field of cryogenic distillation air separation and more particularly is an improvement whereby oxygen gas may be produced efficiently having ultrahigh purity.

BACKGROUND OF THE INVENTION

The cryogenic separation of air is a well established industrial process. Cryogenic air separation involves the filtering of the feed air to remove particulate matter and compression of that clean air to supply the energy required for the separation. Following the air compression the feed air stream is cooled and cleaned of the high boiling contaminants, such as carbon dioxide and water vapor, and then separated into its components by cryogenic distillation. The separation columns are operated at cryogenic temperatures to allow the gas and liquid contacting necessary for separation by distillation and the separated products are then returned to ambient temperature conditions versus the cooling air stream. The separation columns are commonly used to produce oxygen, nitrogen, argon and the rare gases present in the feed air. The typical oxygen purity available from cryogenic air separation can range from enriched air to the high purity oxygen considered standard for the industry. Enriched air product which may range from 25% oxygen to perhaps 50% oxygen is often used in low grade combustion type applications, such as blast furnaces. Higher purity oxygen product such as 50–95% oxygen is often used for applications where the added oxygen content is beneficial but the remaining nitrogen is not a serious drawback. Typical applications can include some combustion purposes, chemical processes, and secondary waste-water treatment. The conventional high purity oxygen product which is nominally referred to as 99.5% oxygen is the usual product purity associated with cryogenic air separation. The conventional 99.5% oxygen associated with air separation industry is commonly used for a range of applications including metal cutting and working operations and various medical uses such as breathing oxygen.

The conventional high purity oxygen is composed of 99.5% oxygen, 0.5% argon, and essentially negligible nitrogen. However, that 99.5% oxygen purity includes trace amounts of heavy constituents present in the feed air such as krypton, xenon, and the hydrocarbons associated with the feed air. Since the cryogenic separation of feed air involves the separation by distillation, the separate components remain in the product streams dependent on their vapor pressure relative to one another. Of the primary components in the feed air, nitrogen is the most volatile, argon has intermediate volatility, and oxygen is the least volatile component. Additional trace components such as helium and hydrogen are more volatile than nitrogen and thereby exit the air separation plant with nitrogen rich streams. However, other trace components such as krypton and xenon are less volatile than oxygen and thereby will concentrate with the oxygen product. Similarly other heavy components such as propane, butane, and methane, are also less volatile than oxygen and will concentrate with the product oxygen. The trace components involved are generally in the parts per million purity range and do not normally constitute an impurity for conventional air separation processes.

Although the conventional high purity oxygen product is considered satisfactory for many industrial applications, it does not have sufficient purity specifications for some industrial applications. In particular, the electronics industry requires a higher grade product oxygen than the usual specification. The processes involved with this industry are such that trace amounts of heavy components such as argon, krypton, and the hydrocarbons will adversely impact on the quality of the final product. Accordingly, it is common for this industry to require oxygen product purity specifications that are considerably higher than the conventional high purity specification. Often the electronics industry applications require oxygen product with total impurity content of less than 100 ppm or even less than 50 ppm. Additionally, some heavy components such as krypton and hydrocarbons are especially detrimental to the quality of the products associated with the industry.

Furthermore, industrial applications such as the electronics industry often require elevated pressure nitrogen in addition to ultrahigh purity oxygen. The nitrogen is used as an inerting or blanketing gas and is needed at pressure for both flow distribution purposes and because some of the end use processes can operate at elevated pressure levels. The nitrogen is preferably produced at pressure directly from the air separation column, since any subsequent gas compression system has the potential to introduce undesirable particulates. The particulate content of the gases used within the electronics industry is important, since the particulates can settle and adversely affect the quality of the indicated electronic devices.

Although air separation processes are available to produce either ultrahigh purity oxygen or elevated pressure nitrogen products, there is a need to produce both products for the electronics industry. Such an air separation process would significantly improve the economics of the gas supply.

Therefore, it is an object of this invention to provide an improved process for cryogenic distillation separation of air.

It is a further object of this invention to provide an improved air separation process to produce ultrahigh purity oxygen.

It is a still further object of this invention to provide an improved air separation process to produce ultrahigh purity oxygen having a very low krypton content.

It is another object of this invention to provide an improved air separation process to produce ultrahigh purity oxygen having a very low hydrocarbon content.

It is yet another object of this invention to provide an improved air separation process to produce ultrahigh purity oxygen while also producing elevated pressure nitrogen.

SUMMARY OF THE INVENTION

The above and other objects which will become apparent to one skilled in the art upon a reading of this disclosure are attained by this invention which comprises:

A cryogenic air separation process for the production of elevated pressure nitrogen, and ultrahigh purity oxygen containing no more than 100 ppm of impurities, comprising:

(A) introducing cleaned cooled feed air into a primary column operating at a pressure in the range of from 40 to 200 psia;

(B) separating said feed air in said primary column into a nitrogen-rich vapor and an oxygen-enriched liquid;

(C) recovering a first portion of said nitrogen-rich vapor as elevated pressure nitrogen gas;

(D) providing reflux liquid for the primary column;

(E) introducing a first portion of said oxygen-enriched liquid as feed into a secondary column operating at a pressure in the range of from 15 to 75 psia;

(F) separating said feed in said secondary column into a vapor fraction and a liquid fraction;

(G) withdrawing a first portion of said liquid fraction from said secondary column;

(H) vaporizing a second portion of said liquid fraction to provide reflux vapor for said secondary column;

(I) withdrawing a vapor stream from said secondary column at a point above at least one equilibrium stage above the vaporizing second liquid portion of step (H); and (J) recovering said withdrawn vapor stream as product ultrahigh purity oxygen having no more than 100 ppm of impurities.

Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns.

The term, "column", as used in the present specification and claims, means a distillation or fractionation column or zone, i.e., a contacting column or zone wherein liquid and vapor phases are countercurrently contacted to effect separation of a fluid mixture, as for example, by contacting of the vapor and liquid phases on a series or vertically spaced trays or plates mounted within the column or alternatively, on packing elements with which the column is filled. For a further discussion of distillation columns see the Chemical Engineers' Handbook. Fifth Edition, edited by R. H. Perry and C. H. Chilton, MrGraw-Hill Book Company, New York, Section 13, "Distillation" B. D. Smith et al, page 13-3, *The Continuous Distillation Process.*

The term "indirect heat exchange", as used in the present specification and claims, means the bringing of two fluid streams into heat exchange relation without any physical contact or intermixing of the fluids with each other.

As used herein, the term "equilibrium stage" means a vapor-liquid contacting stage whereby the vapor and liquid leaving that stage are in mass transfer equilibrium. For a separation column that uses trays or plates, i.e. separation and discrete contacting stages for the liquid and gas phases, an equilibrium stage would correspond to a theoretical tray or plate. For a separation column that uses packing, i.e. continuous contacting of the liquid and gas phases, an equilibrium stage would correspond to that height of column packing equivalent to one theoretical plate. An actual contacting stage, i.e. trays, plates, or packing, would have a correspondence to an equilibrium stage dependent on its mass transfer efficiency.

As used herein, the term "impurities" means all components other than oxygen. The impurities include but are not limited to argon, krypton, xenon, and hydrocarbons such as methane, ethane and butane.

As used herein, the term "ppm" is an abbreviation for "parts per million".

DETAILED DESCRIPTION

The process of this invention will be described in detail with reference to the drawings.

Figure 1:
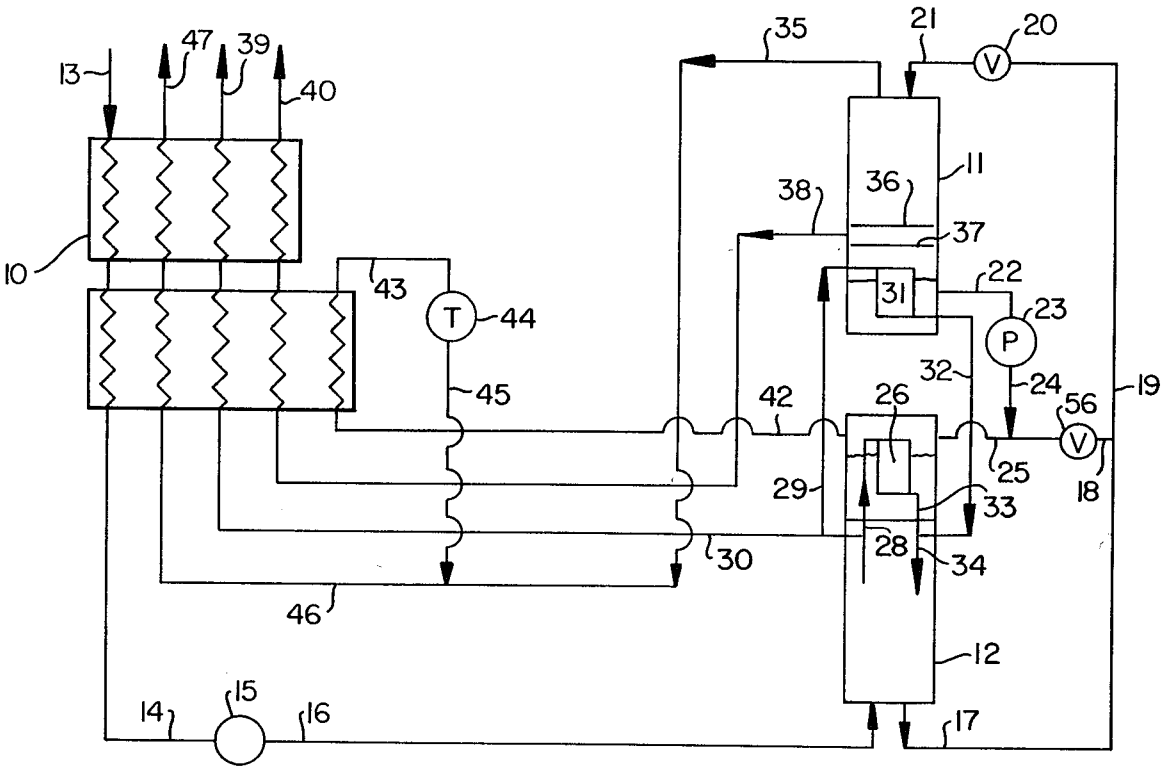
FIG. 1 is a schematic representation of one preferred embodiment of the process of this invention wherein the first and second portions of oxygen-enriched liquid are withdrawn from the primary column at the bottom of the column.

Referring now to FIG. 1, pressurized feed air 13 at ambient temperature is cooled by passage through heat exchanger 10 against outgoing streams. In FIG. 1, heat exchanger 10 is a reversing heat exchanger wherein high boiling air contaminants such as carbon dioxide and water vapor are removed from the feed air in a manner well known to those skilled in the art. Alternatively the compressed feed air may pass through adsorbent purifiers to remove carbon dioxide and water vapor. Trace amounts of these high boiling impurities may be removed by passing the cleaned feed air 14 through adsorbent trap 15, such as a silica gel trap. The cleaned cool feed air is then introduced into primary column 12, preferably at the bottom of the column. Primary column 12 operates at a pressure in the range of from 40 to 200 pounds per square inch absolute (psia), preferably from 45 to 150 psia.

Within primary column 12 the feed air is separated by rectification into a nitrogen-rich vapor and an oxygen-enriched liquid. A first portion 30 of the nitrogen-rich vapor is withdrawn from the column, warmed by passage through heat exchanger 10 and recovered as elevated pressure nitrogen gas 39 at a pressure up to the pressure at which the primary column is operating. Primary column 12 is sized so as to have sufficient equilibrium stages to attain nitrogen of a purity sufficient for its intended use. A second portion 28 of the nitrogen-rich vapor is condensed in condenser 26 and the resulting liquid nitrogen 33 is returned to primary column 12 as liquid reflux. A small portion of liquid nitrogen 33 may be recovered if desired. A third portion 29 of the nitrogen-rich vapor is passed to condenser 31 and condensed by indirect heat exchange with vaporizing bottoms of secondary column 11. The resulting liquid nitrogen 32 is returned to primary column 12 as liquid reflux. If desired, a portion of stream 32 may be recovered as liquid nitrogen. As shown in FIG. 1, the liquid third portion 32 may be combined with liquid second portion 33 to form combined liquid 34 for liquid reflux for primary column 12.

Oxygen-enriched liquid is withdrawn from primary column 12. A first portion of oxygen-enriched liquid is introduced as feed into secondary column 11 and a second portion of oxygen-enriched liquid is passed to the area of condenser 26 wherein it is vaporized against condensing second nitrogen portion 28 to produce oxygen-enriched vapor.

FIG. 1 illustrates an embodiment wherein both the first and second portions of the oxygen-enriched liquid are withdrawn together from the bottom of primary column 12 as stream 17. This stream 17 is then divided into first oxygen-rich liquid portion 19 and second oxygen-rich liquid portion 18. Portion 19 is expanded through valve 20 and the resulting stream 21 is introduced into secondary column 11, preferably at the top of the column. Secondary column 11 is operating at a pressure in the range of from 5 to 75 psia, preferably from 15 to 45 psia. Portion 18 is passed through valve 56 to refrigerate condenser 26. The resulting oxygen-enriched vapor 42 is withdrawn and may be employed for cold end temperature control of desuperheater 10 by partial passage through this heat exchanger. The warmed but still pressurized stream 43 may be expanded through turboexpander 44 to produce plant refrigeration and the resulting low pressure stream 45 is passed out through heat exchanger 10 to cool incoming feed air. The first oxygen enriched liquid portion comprises from 10 to 50 percent, preferably from 20 to 40 percent, of the oxygen-enriched liquid.

Within secondary column 11 the first oxygen-enriched liquid portion is separated by rectification into a vapor fraction and a liquid fraction. The vapor fraction is withdrawn from the secondary column, preferably from the top of the column, and the withdrawn vapor fraction 35 is passed out of the process as stream 47. As shown in FIG. 1, fraction 35 may be combined with expanded stream 45 and combined stream 46 may be passed through heat exchanger 10 to cool incoming feed air before passing out of the process as stream 47.

A first portion 22 of the liquid fraction is withdrawn from secondary column 11. Some or all of first portion 22 may be removed from the process. Alternatively, some or all of first portion 22 may be combined with the second oxygen-enriched liquid fraction and the resulting combination employed to refrigerate condenser 26 resulting in oxygen-enriched vapor 42 which may then be expanded and warmed to cool incoming feed air. As shown in FIG. 1, first portion 22 is pumped by pump 23 and the resulting pressurized stream 24 is combined with stream 18 to form stream 25 which is then passed to the area of condenser 26 to refrigerate the condenser.

A second portion of the liquid fraction of the secondary column 11 is vaporized to provide vapor reflux for the secondary column. In the FIG. 1 embodiment, the second portion of the liquid fraction is vaporized by indirect heat exchange with third portion 29 of the nitrogen-rich vapor.

A vapor stream 38 is withdrawn from secondary column 11 at a point above at least one equilibrium stage above the vaporizing second portion of the liquid fraction. Vapor stream 38 may be withdrawn up to five equilibrium stages above the vaporizing second portion of the liquid fraction. In FIG. 1 the first equilibrium stage above the vaporizing second portion is tray 37 and the second equilibrium stage is tray 36. Vapor stream 38 is withdrawn between bottom tray 37 and second from the bottom tray 36. Withdrawn vapor stream 38 contains less than 100 ppm, preferably less than 50 ppm of impurities, and most preferably less than 30 ppm of impurities. Typically withdrawn stream 38 contains less than 15 ppm of argon, less then 2 ppm of krypton and less than 10 ppm of hydrocarbons.

By withdrawing vapor streams 38 from above at least one equilibrium stage above the sump of secondary column 11, the withdrawn vapor contains very little of the impurities less volatile then oxygen because these lower boiling impurities preferentially remain in the liquid which is passing downward through column 11 and are not vaporized. Furthermore, the bulk of these impurities which do vaporize are stripped back into the downflowing liquid at the first equilibrium stage. The impurities more volatile than oxygen are removed in large part with withdrawn vapor fraction 35 considerably above the point where vapor stream 38 is withdrawn. Therefore impurities more volatile than oxygen are removed above vapor stream 38 and impurities less volatile then oxygen are mostly in liquid form at the point where vapor stream 38 is withdrawn, resulting in vapor stream 38 being comprised of oxygen of ultrahigh purity. Buildup of less volatile impurities in secondary column 11 is prevented by the withdrawal from the column of liquid stream 22.

Withdrawn stream 38 comprises from about 1 to 25 percent, preferably from 3 to 18 percent, of the feed to secondary column 11. Stream 38 may be further purified prior to recovery such as by passage through a catalytic reactor to remove residual hydrocarbons. Stream 38 may be partially or totally liquified by liquifaction processes known to those skilled in the art so that the product ultrahigh purity oxygen is recovered, at least in part, as liquid. As shown in FIG. 1, withdrawn stream 38 may be warmed, such as by passage through heat exchanger 10 to cool incoming feed air, prior to recovery. The product stream 40 is recovered as product ultrahigh purity oxygen having no more than 100 ppm of impurities.

Figure 2:
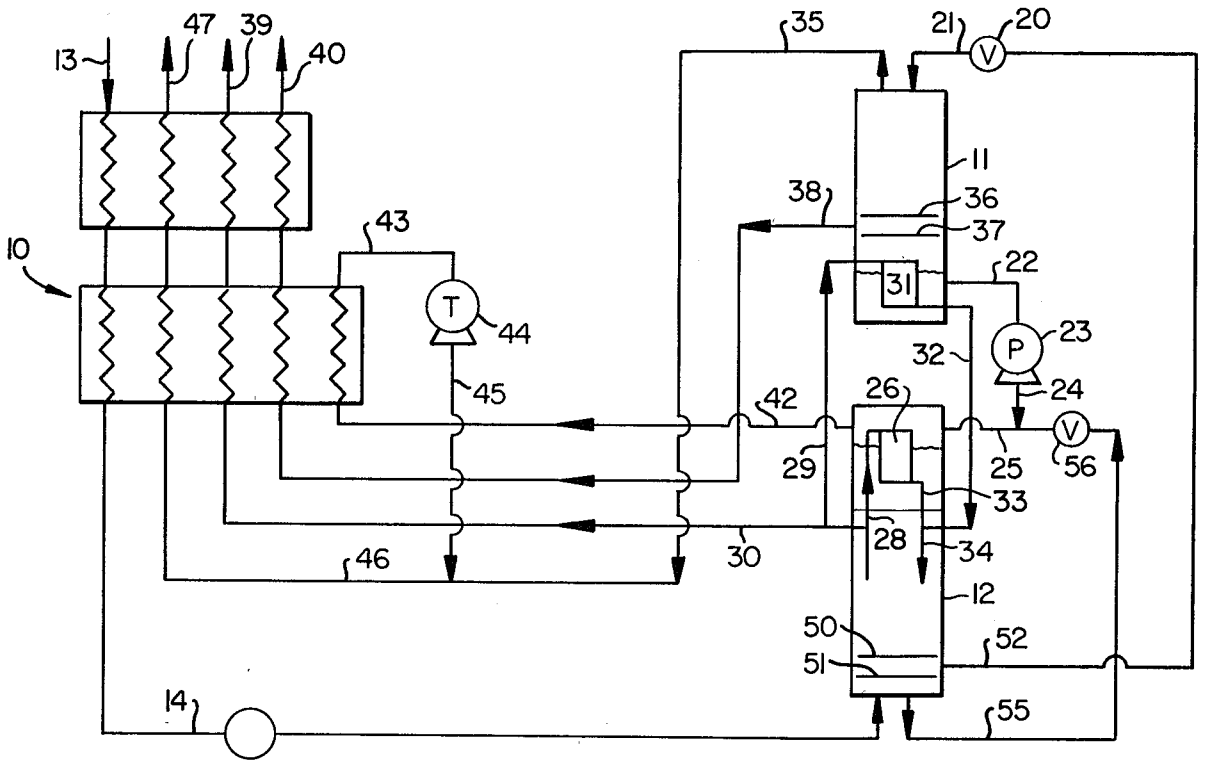
FIG. 2 is a schematic representation of another preferred embodiment of the process of this invention wherein the first portion of oxygen-enriched liquid is withdrawn from the primary column at least one equilibrium stage above the bottom of the primary column.

FIG. 2 illustrates another preferred embodiment of the process of this invention wherein the first portion of the oxygen-enriched liquid is withdrawn from above the bottom of the primary column. The numerals of FIG. 2 are the same as those of FIG. 1 for the common elements. Referring now to FIG. 2, second oxygen-enriched liquid portion 55 is taken from the bottom of primary column 12, passed through valve 56 and into column 12 to refrigerate condenser 26. Separate from portion 55, first oxygen-enriched portion 52 is withdrawn from primary column 12 at a point at least one equilibrium stage above the bottom of the column. In FIG. 2, portion 52 is withdrawn at a point between bottom tray 51 and second to the bottom tray 50. In this way the liquid feed to the secondary column contains a smaller concentration of impurities less volatile than oxygen than would be the case if the first oxygen-enriched portion is withdrawn from the bottom of primary column 12 as in the FIG. 1 embodiment. Although this arrangement allows greater control of impurities in the feed to the secondary column, it involves a more complex primary column. As in the FIG. 1 embodiment, the first oxygen-enriched liquid portion is expanded and introduced as feed into the secondary column.

Figure 3:
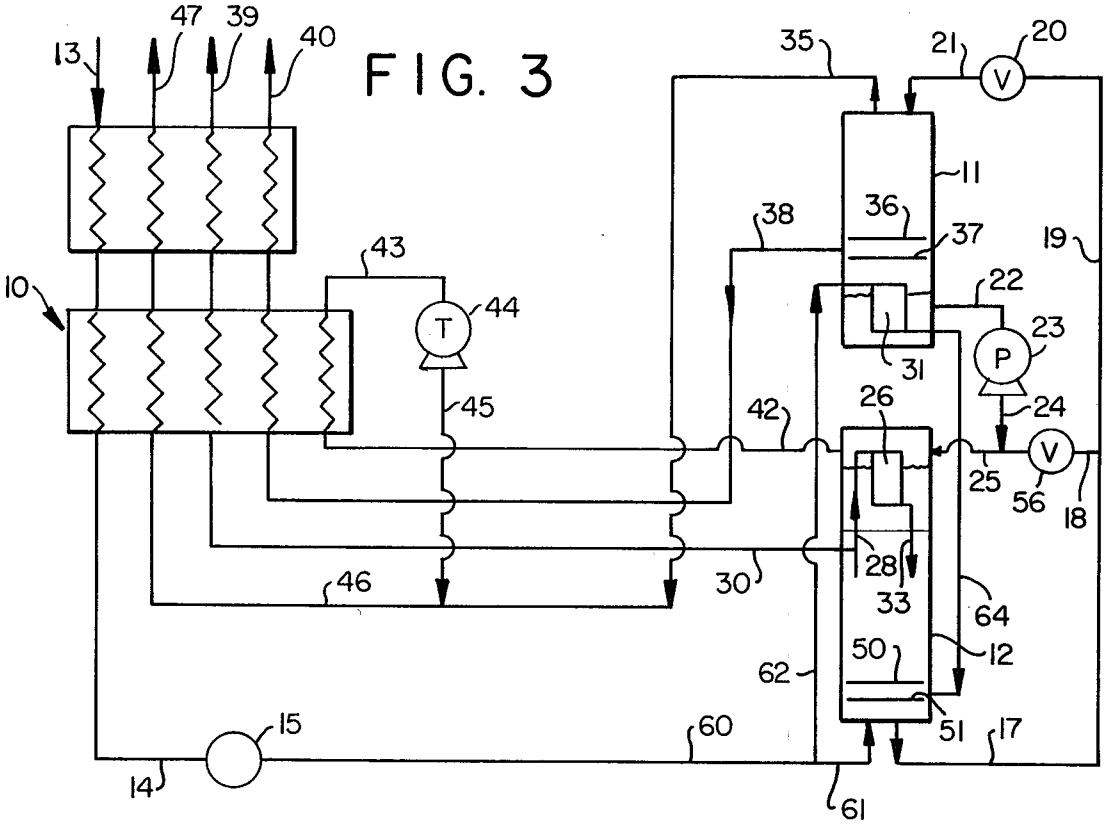
FIG. 3 is a schematic representation of another preferred embodiment of the process of this invention wherein feed air is condensed to reboil the bottoms of the secondary column.

FIG. 3 illustrates another preferred embodiment of the process of this invention wherein the bottoms of the secondary column are reboiled by indirect heat exchange with condensing feed air. The numerals of FIG. 3 are the same as those of FIG. 1 for the common elements. Referring now to FIG. 3, cleaned, cool compressed feed air 60 is divided into major fraction 61, which is introduced into primary column 12, and minor portion 62 which is condensed in condenser 31 to effect the vaporization of the second portion of the secondary column liquid fraction. The resulting condensed air 64 is preferably introduced into primary column 12 as feed and most preferably is introduced into primary column 12 at least one equilibrium stage above the bottom of column 12 since the bottom liquid contains a higher concentration of oxygen than liquid air. In the FIG. 3 embodiment, liquid air 64 is introduced into primary column 12 between bottom tray 51 and second from the bottom tray 50.

There are a number of other variations which may be employed in the process of this invention. For example, those skilled in the art are aware of many heat transfer steps within the process which may be undertaken, such as subcooling liquid streams prior to expansion with return waste or product streams. In another variation some of the compressed feed air may be turboexpanded to provide plant refrigeration instead of stream 42 which, in this variation, would be at lower pressure.

Table I tabulates the results of a computer simulation of the process of this invention carried out in accord with the embodiment illustrated in FIG. 1. The stream numbers correspond to those of FIG. 1. The abbreviation mcfh means thousands of cubic feet per hour at standard conditions. Purity is in mole percent unless ppm is indicated. The first oxygen-enriched liquid portion which was fed to the secondary column was about 27 percent of the oxygen-enriched liquid at the bottom of the primary column.

TABLE 1

| Stream No. | 16 | 17 | 19 | 30 |
|---|---|---|---|---|
| Flow, mcfh | 575 | 350 | 95 | 226 |
| Pressure, psia | 130 | 130 | 130 | 127 |
| Temperature, °K. | 109 | 106 | 106 | 102 |
| Purity | | | | |
| Oxygen, % | 21.0 | 34.6 | 34.6 | 1 ppm |
| Nitrogen | 78.1 | 63.9 | 63.9 | 99.97 |
| Argon | 0.9 | 1.5 | 1.5 | 300 ppm |
| Krypton ppm | 1.1 | 1.9 | 1.9 | — |
| Xenon ppm | 0.1 | 0.1 | 0.1 | — |
| Methane ppm | 2.0 | 3.3 | 3.3 | — |
| Other ppm Hydrocarbons | 0.1 | 0.2 | 0.2 | — |
| **Stream No.** | **42** | **22** | **35** | **38** |
| Flow, mcfh | 256 | 2 | 82.2 | 10.8 |
| Pressure, psia | 71 | 22 | 18 | 22 |
| Temperature, °K. | 100 | 94 | 84 | 94 |
| Purity | | | | |
| Oxygen, % | 35.1 | 99.98 | 24.4 | 99.998 |
| Nitrogen | 63.4 | — | 73.9 | — |
| Argon | 1.5 | 10 ppm | 1.7 | 10 ppm |
| Krypton ppm | 2.5 | 79 | 0.1 | 1.3 |
| Xenon ppm | 0.2 | 6 | — | — |
| Methane ppm | 4.0 | 89 | 0.6 | 8 |
| Other ppm Hydrocarbons | 0.3 | 10 | — | — |

By the use of the process of this invention one can now produce efficiently both ultrahigh purity oxygen and elevated pressure nitrogen.

Although the process of this invention has been described in detail with reference to certain preferred embodiments, it is recognized that there are other embodiments of this invention which are within the scope of the claims.

I claim:

1. A cryogenic air separation process for the production of elevated pressure nitrogen, and ultrahigh purity oxygen containing no more than 100 ppm of impurities, comprising:

(A) introducing cleaned cooled feed air into a primary column operating at a pressure in the range of from 40 to 200 psia;

(B) separating said feed air in said primary column into a nitrogen-rich vapor and an oxygen-rich liquid;

(C) recovering a first portion of said nitrogen-rich vapor as elevated pressure nitrogen gas;

(D) providing reflux liquid for the primary column;

(E) introducing a first portion of said oxygen-enriched liquid as feed into a secondary column operating at a pressure in the range of from 15 to 75 psia;

(F) separating said feed in said secondary column into a vapor fraction and a liquid fraction;

(G) withdrawing a first portion of said liquid fraction from said secondary column;

(H) vaporizing a second portion of said liquid fraction to provide reflux vapor for said secondary column;

(I) withdrawing a vapor stream from said secondary column at a point above at least one equilibrium stage above the vaporizing second liquid portion of step (H); and (J) recovering said withdrawn vapor stream as product ultrahigh purity oxygen generally suitable for use in such as the electronics industry and having no more than 100 ppm of impurities.

2. The process of claim 1 wherein a second portion of said nitrogen-rich vapor is condensed to provide reflux liquid for said primary column.

3. The process of claim 2 wherein said second portion of said nitrogen-rich vapor is condensed by indirect heat exchange with a second portion of said oxygen-enriched liquid to produce oxygen-enriched vapor.

4. The process of claim 3 wherein the oxygen-enriched vapor is expanded, and warmed by indirect heat exchange with incoming feed air to cool the feed air.

5. The process of claim 1 wherein at least some of the first portion of the liquid fraction withdrawn from the secondary column in step (G) is removed from the process.

6. The process of claim 3 wherein at least some of the first portion of the liquid fraction withdrawn from the secondary column in step (G) is combined with the second portion of said oxygen-enriched liquid and the resulting combination vaporized to produce oxygen-enriched vapor.

7. The process of claim 6 wherein the oxygen-enriched vapor is expanded, and warmed by indirect heat exchange with incoming feed air to cool the feed air.

8. The process of claim 1 wherein a third portion of said nitrogen-rich vapor is condensed to effect the vaporization of the second portion of said liquid fraction in step (H).

9. The process of claim 8 wherein at least some of the condensed nitrogen-rich third portion is recovered as liquid nitrogen.

10. The process of claim 8 wherein at least some of the condensed nitrogen-rich third portion is passed to the primary column as liquid reflux.

11. The process of claim 1 wherein the cleaned cooled feed air is introduced into the primary column at the bottom of the primary column.

12. The process of claim 1 wherein the first portion of said oxygen-enriched liquid is introduced into the secondary column at the top of the secondary column.

13. The process of claim 1 wherein a portion of the cleaned cooled feed air is condensed to effect the vaporization of the second portion of said liquid fraction in step (H).

14. The process of claim 13 wherein the condensed feed air portion is passed into the primary column.

15. The process of claim 14 wherein the condensed feed air portion is passed into the primary column at a point above at least one equilibrium stage above the bottom of the primary column.

16. The process of claim 1 wherein the first portion of said oxygen-enriched liquid introduced into the secondary column in step (E) is taken from the bottom of the primary column.

17. The process of claim 1 wherein the first portion of said oxygen-enriched liquid introduced into the secondary column in step (E) is taken from at least one equilibrium stage above the bottom of the primary column.

18. The process of claim 1 wherein the first portion of said oxygen-enriched liquid introduced into the secondary column in step (E) comprises from 10 to 50 percent of the oxygen-enriched liquid.

19. The process of claim 1 wherein the feed air is cleaned and cooled by passage through a reversing heat exchanger.

20. The process of claim 1 wherein the feed air is cleaned by passage through a gel trap.

21. The process of claim 1 wherein the feed air is expanded prior to introduction into the primary column to provide refrigeration to the process.

22. The process of claim 1 wherein at least some of the vapor fraction from the secondary column is withdrawn from the column above the point where the vapor stream of step (I) is withdrawn.

23. The process of claim 1 wherein the vapor stream withdrawn from the secondary column in step (I) is further purified prior to recovery.

24. The process of claim 23 wherein said further purification comprises passing the withdrawn vapor stream through a catalytic reactor.

25. The process of claim 1 wherein the vapor stream withdrawn from the secondary column in step (I) is warmed prior to recovery.

26. The process of claim 25 wherein said withdrawn vapor stream is warmed by indirect heat exchange with incoming feed air.

27. The process of claim 1 wherein at least a portion of the vapor stream withdrawn from the secondary column in step (I) is liquified prior to recovery.

28. The process of claim 1 wherein the product ultra-high purity oxygen contains no more than 50 ppm of impurities.

29. The process of claim 1 wherein the product ultra-high purity oxygen comprises from 1 to 25 percent of the feed to the secondary column.

30. The process of claim 1 wherein the elevated pressure nitrogen gas recovered in step (C) is at a pressure up to the pressure at which the primary column is operating.

31. The process of claim 1 wherein the primary column is operating at a pressure in the range of from 45 to 150 psia.

32. The process of claim 1 wherein the secondary column is operating at a pressure in the range of from 15 to 45 psia.

33. The process of claim 1 wherein the product ultra-high purity oxygen contains no more than 30 ppm of impurities.

* * * * *

UNITED STATES PATENT AND TRADEMARK OFFICE

CERTIFICATE OF CORRECTION

PATENT NO. : 4,560,397

DATED : December 24, 1985

INVENTOR(S) : Harry Cheung

It is certified that error appears in the above-identified patent and that said Letters Patent is hereby corrected as shown below:

In column 5, line 31, delete "5" and substitute therefor --15--.

Signed and Sealed this

*Eighteenth* Day of *March 1986*

[SEAL]

*Attest:*

DONALD J. QUIGG

*Attesting Officer*

*Commissioner of Patents and Trademarks*